US005715897A

United States Patent [19]

Gustafsson

[11] Patent Number: 5,715,897

[45] Date of Patent: Feb. 10, 1998

[54] IN-HOLE ROCK DRILLING MACHINE WITH A HYDRAULIC IMPACT MOTOR

[75] Inventor: Per Gustafsson, Formigine, Italy

[73] Assignee: G-Drill AB, Stockholm, Sweden

[21] Appl. No.: 664,905

[22] Filed: Jun. 12, 1996

Related U.S. Application Data

[63] Continuation-in-part of PCT/SE094/01196, Dec. 13, 1994, and a continuation-in-part of PCT/SE94/01201, Dec. 13, 1994.

[30] Foreign Application Priority Data

Dec. 13, 1993 [SE] Sweden ..... 9304124-2
Dec. 13, 1993 [SE] Sweden ..... 9304125-9

[51] Int. Cl.[6] ..... E21B 4/14; E21B 10/60

[52] U.S. Cl. ..... 175/296; 175/297; 173/17; 173/80

[58] Field of Search ..... 175/296, 297, 175/92, 215; 173/17, 80, 138, 73

[56] References Cited

U.S. PATENT DOCUMENTS

| | | | |
|---|---|---|---|
| 3,896,886 | 7/1975 | Roscoe, Jr. | 173/17 |
| 4,172,411 | 10/1979 | Matsuda et al. | 91/278 |
| 4,278,135 | 7/1981 | Curington | 173/29 |
| 4,534,422 | 8/1985 | Rear | 173/134 |
| 4,583,601 | 4/1986 | Techy | 173/134 |
| 4,819,746 | 4/1989 | Brown et al. | 175/296 |
| 4,921,056 | 5/1990 | Ennis | 175/92 |
| 5,056,606 | 10/1991 | Barthomeuf | 173/13 |

FOREIGN PATENT DOCUMENTS

| | | |
|---|---|---|
| 1188526 | 3/1965 | Germany . |
| 2362724 | 7/1974 | Germany . |

*Primary Examiner*—Frank Tsay
*Attorney, Agent, or Firm*—Nils H. Ljungman and Associates

[57] ABSTRACT

An in-hole rock drilling machine has a hydraulic impact motor within a housing. The hydraulic impact motor has a spool valve contained within a valve housing. The spool valve has two operating positions to alternately pressurize and depressurize a drive chamber to reciprocate a hammer. The spool valve has a continuously pressurized third control surface that biases the spool valve towards a second operating position, a first control surface that acts opposite the third control surface to move the spool valve to a first operating position, and a second control surface that acts with the third control surface to return the spool valve to the second operating position. The valve housing guides the rear portion of the hammer, and a guide bushing guides the front portion of the hammer. The guide bushing, valve housing, and a distance sleeve are clamped against a shoulder of the housing. The distance sleeve compresses axially to compensate for the axial tolerances of the component parts, thereby making axial tolerances less critical, and assembly and disassembly simple.

20 Claims, 2 Drawing Sheets

IN-HOLE ROCK DRILLING MACHINE WITH A HYDRAULIC IMPACT MOTOR

CONTINUING APPLICATION DATA

This application is a Continuation-In-Part of International Patent Application No. PCT/SE94/01196 filed on Dec. 13, 1994 and published Jun. 22, 1995, which claims priority from Swedish Patent Application No. 9304124-2 filed on Dec. 13, 1993. International Application No. PCT/SE 94/01196 was pending as of the filing date of this application and designated the United States of America as a designated state.

This application is a Continuation-In-Part of International Patent Application No. PCT/SE 94/01201 filed on Dec. 13, 1994 and published on Jun. 22, 1995, which claims priority from Swedish Patent Application No. 9304125-9 filed on Dec. 13, 1993. International Application No. PCT/SE 94/01201 was pending as of the filing date of this application and designated the United States of America as a designated state.

BACKGROUND OF THE INVENTION

1. Background of the Invention

The present invention generally relates to an in-hole rock drilling machine driven by a hydraulic impact motor. The in-hole rock drilling machine includes a tubular housing with a guide bushing in its front end arranged to guide the front end of a piston hammer, and is designed to be easily assembled and disassembled. A valve housing of the hydraulic impact motor is arranged to guide the rear end of the piston hammer. The rear guiding surface is kept short for extended operating life. Further, the hydraulic impact motor includes a valve arrangement that results in increased power efficiency.

The output power of in-hole rock drilling machines and the penetration rate are usually low as compared with top-hammer drills. Still, such in-hole rock drilling machines are widely used because the overall cost per meter of drilling distance or depth is comparatively low for this kind of drilling and because the penetration rate is not substantially reduced as the hole becomes deeper.

Conventionally, the drive fluid is compressed air, but hydraulically operated in-hole rock drilling machines are known. In practice, however, severe difficulties have been encountered when a hydraulic drive fluid is used as a flushing fluid. Top-hammer drills generally use a closed hydraulic circuit so that they can be operated by oil.

Most in-hole rock drilling machines are generally pneumatic. In air operated hammers using open systems are typical because of of the somewhat small outer diameter of an in-hole rock drilling machine. The output of impact energy is hence rather small, as compared to a modern top hammer. An open hydraulic system for an in-hole hammer cannot usually use oil. Further, the lack of lubricant is often a severe problem.

2. Background Information

An in-hole rock drilling machine, also called a down-the-hole rock drilling machine, that is hydraulically driven is disclosed in U.S. Pat. No. 5,107,944. In the machine described therein, water delivered at pressure is the working hydraulic fluid. Spent hydraulic fluid (water) is used as a flushing fluid. A piston hammer is provided to repetitively deliver impacts to a drill bit. A control valve is arranged to pressurize a drive chamber with the hydraulic fluid to drive the piston hammer forwardly to strike the drill bit, and to then depressurize the drive chamber to allow the return stroke of the piston hammer. Movement of the control valve between two stable operating positions controls the alternating pressurization and depressurization of the drive chamber.

In this known machine, the control valve is a spool valve with two control surfaces for shifting the valve between its two stable positions. One of the control surfaces is continuously pressurized during the drilling operation, and the other is pressurized and depressurized through a control passage that has ports against the surface of the piston hammer that is in sliding contact with the cylinder. The sliding surface of the piston hammer has a control groove that is axially long, which makes the guided surface of the hammer piston long. A long guided surface is detrimental to the expected life. Further, the leakage from the two cylinder chambers for driving the hammer piston reduces the power efficiency.

OBJECT OF THE INVENTION

One object of the present invention to provide is an in-hole rock drilling machine driven by a hydraulic impact motor that has shorter guiding surfaces of the piston hammer, longer expected life of the piston hammer and its guiding surfaces, and an increased power efficiency. An additional object of the present invention is to make such an in-hole rock drilling machine more simple, and in particular, to reduce the demands on axial tolerances and to simplify assembly and disassembly of the machine.

SUMMARY OF THE INVENTION

One aspect of the present invention resides broadly in a hydraulic impact motor comprising a housing, a piston hammer reciprocable in the housing and driven to reciprocate by the pressure in two pressure chambers, a spool valve for alternately pressurizing and draining at least one of the pressure chambers so as to reciprocate the piston hammer, the spool valve having a first control surface in a first control chamber and a second control surface in a second control chamber and opposite directed relative to the first control surface, the first and second control chambers being arranged to be pressurized and depressurized, in response to the position of the piston hammer, through control ports controlled by the piston hammer and control conduits characterized by a third control surface on the spool valve in a continuously pressurized chamber and acting in the same direction as the second control surface, the second and third control surfaces being greater than the first control surface and the first control surface being greater than the third control surface so that the spool valve is moved in the one direction when the first control chamber is pressurized and the second control chamber is depressurized and moved in the other direction when the first and second control chambers have equal pressure.

Another feature of the present invention resides broadly in a hydraulic impact motor characterized in that the first control chamber is arranged to be pressurized from one of the drive chambers for the piston hammer for initiating the movement of the spool valve in the one direction, and the second control chamber is arranged to be pressurized from the other one of the drive chambers for initiating the movement of the spool valve in the other direction.

Yet another feature of the present invention resides broadly in a hydraulic impact motor, characterized in that the piston hammer is guided at its front end and at its rear end and is unguided therebetween, a rear control surface for controlling the spool valve is defined between a surface in the one drive chamber, that is a rear drive chamber, and a surface in the other drive chamber, that is a continuously pressurized front drive chamber, the control conduit to the first control chamber has a port arranged to be opened to the front drive chamber and a port arranged to be opened to the rear drive chamber, and the control conduit to the other control chamber has a port arranged to be opened into the rear drive chamber.

Still another feature of the invention resides broadly in a hydraulic impact motor characterized in that it is an in-hole rock drilling machine and the spent drive fluid expelled from the spool valve is conveyed through a channel in the piston hammer 24 to a drill bit of the drilling machine as a flushing fluid.

A further feature of the invention resides broadly in an in-hole rock drilling machine comprising a tubular housing with a guide bushing in the front end of the housing arranged to guide the front end of a piston hammer and a valve housing in the rear end of the housing arranged to guide the rear end of the piston hammer, characterized in that the guide bushing, the valve housing, and a distance sleeve between them are clamped together against a support for the guide bushing by means of a back head screwed to the housing, the distance sleeve being adapted to be compressed at least about 0.3 pro mille, or about 0.3 millimeters per meter, of its length.

A still further feature of the present invention resides broadly in the machine characterized in that the distance sleeve is adapted to be compressed axially at least about 0.8 pro mille, or about 0.8 millimeters per meter, of its length.

Yet an additional feature of the present invention resides broadly in the machine characterized in that the distance sleeve is adapted to be compressed about 0.3–3 pro mille, or about 0.3–3 millimeters per meter, of its length.

Still another feature of the present invention resides broadly in the machine characterized in that an element between the valve housing and the back head is adapted to be axially compressed at least about 0.3 pro mille, or about 0.3 millimeters per meter, of its length.

A further feature of the present invention resides broadly in the machine characterized in that the element is a filter support.

An additional further feature of the present invention resides broadly in a hydraulic in-hole rock drilling machine that has a housing, a piston hammer disposed in the housing to repetitively deliver impacts to a drill bit mounted at the front end of the housing, with the reciprocation of the piston hammer by pressurizing and draining of at least one of a first pressure chamber and a second pressure chamber, the pressurizing and draining of at least one the first pressure chamber and the second pressure chamber controlled by a spool valve, the spool valve being moveable between a first operating position and a second operating position, the first operating position for pressurizing at least one of the first pressure chamber and the second pressure chamber, the second operating position for draining at least one of the first pressure chamber and the second pressure chamber, the spool valve movable to the first operating position by pressurizing a first control chamber and draining a second control chamber, and the spool valve movable to the second operating position by pressurizing the second control chamber and a continuously pressured third control chamber, the continuously pressured third control chamber generating a continuous pressure bias of the spool valve towards the second operating position, the first control chamber pressurized and drained in response to the position of the piston hammer, and the second control chamber pressurized and drained in response to the position of the piston hammer.

Yet another feature of the present invention resides broadly in an in-hole rock drilling machine that has a housing, the housing having a support, a piston hammer disposed within the housing, with the front end of piston hammer guided by a guide bushing, a distance sleeve located between the guide bushing and a valve housing, the distance sleeve having an elasticity, with assembly of the guide bushing, distance sleeve, and the valve housing by clamping the component parts against the housing support, the elasticity of the distance sleeve compensating for axial tolerances of the clamped components.

A still additional further feature of the present invention resides broadly in a hydraulic impact motor that has a housing, a piston hammer disposed in the housing to repetitively deliver impacts to a target, as for example, a drill bit mounted at the front end of the housing, with the reciprocation of the piston hammer by pressurizing and draining of at least one of a first pressure chamber and a second pressure chamber, the pressurizing and draining of at least one the first pressure chamber and the second pressure chamber controlled by a spool valve, the spool valve being moveable between a first operating position and a second operating position, the first operating position for pressurizing at least one of the first pressure chamber and the second pressure chamber, the second operating position for draining at least one of the first pressure chamber and the second pressure chamber, the spool valve movable to the first operating position by pressurizing a first control chamber and draining a second control chamber, and the spool valve movable to the second operating position by pressurizing the second control chamber and a continuously pressured third control chamber, the continuously pressured third control chamber generating a continuous pressure bias of the spool valve towards the second operating position, the first control chamber pressurized and drained in response to the position of the piston hammer, and the second control chamber pressurized and drained in response to the position of the piston hammer.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention will be described with reference to the drawings in which.

DESCRIPTION OF THE PREFERRED EMBODIMENT

Figure 1:
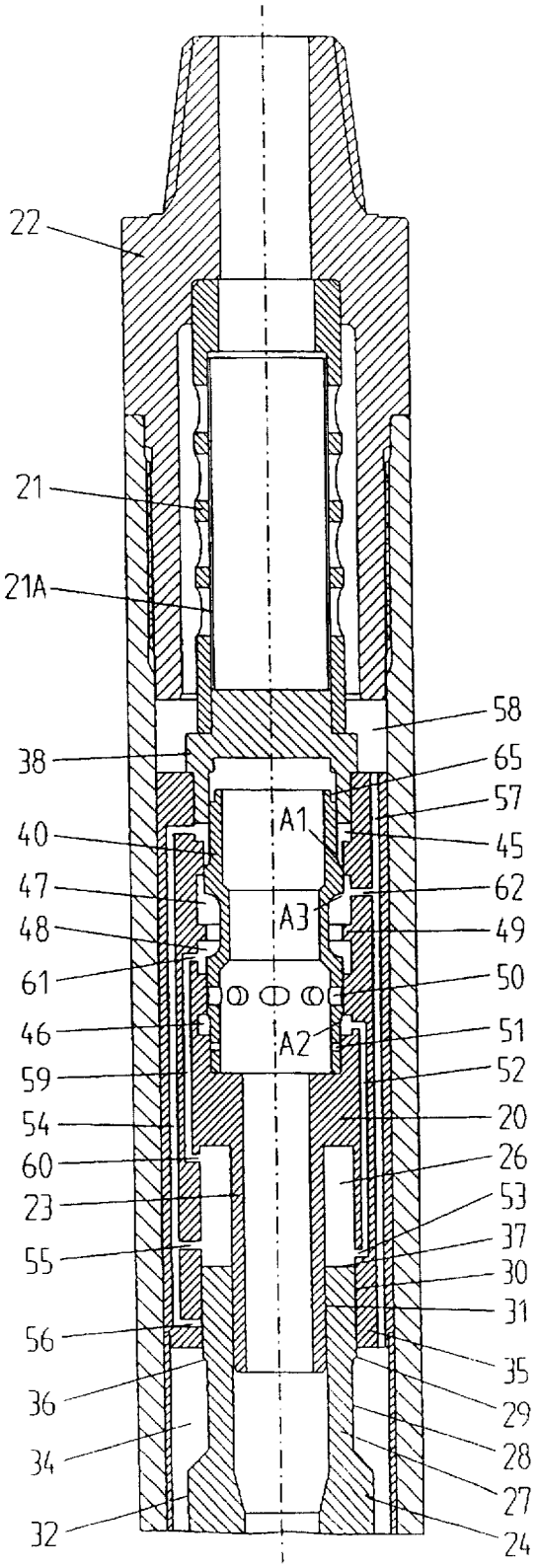
FIG. 1 is a partial sectional view of the rear longitudinal portion of an embodiment of a hydraulic in-hole rock drilling machine.
Figure 2:
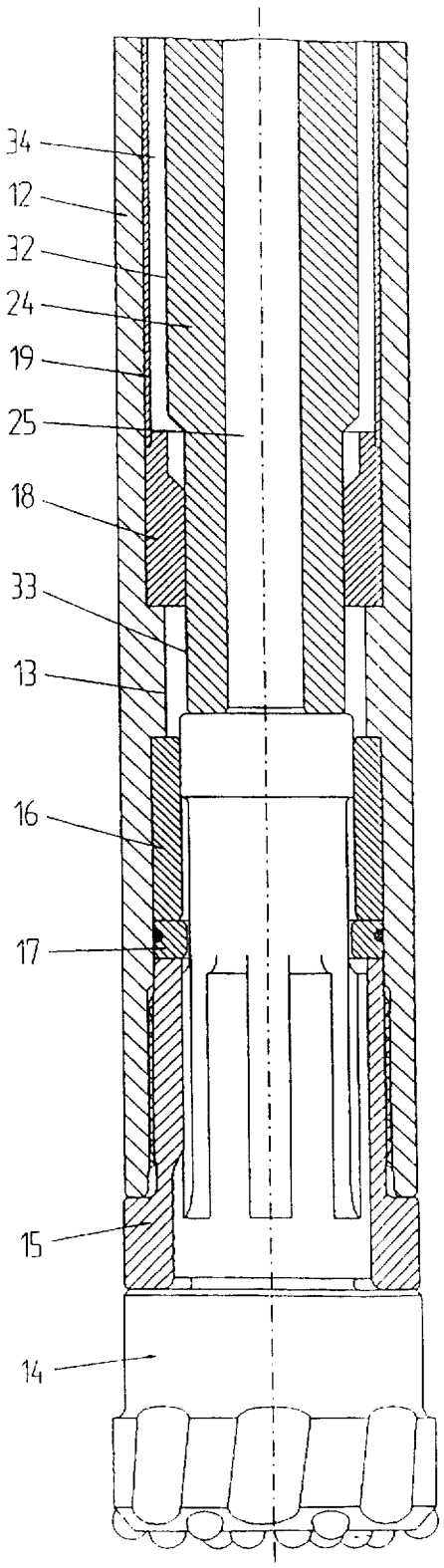
FIG. 2 is a partial sectional view of the forward longitudinal portion of the embodiment of a hydraulic in-hole rock drilling machine.

Referring to FIGS. 1 and 2, the in-hole rock drilling machine shown has a housing, the main part of which is a cylindrical tube 12 that has an interior shoulder 13 and interior threads in each end.

Figure 3:
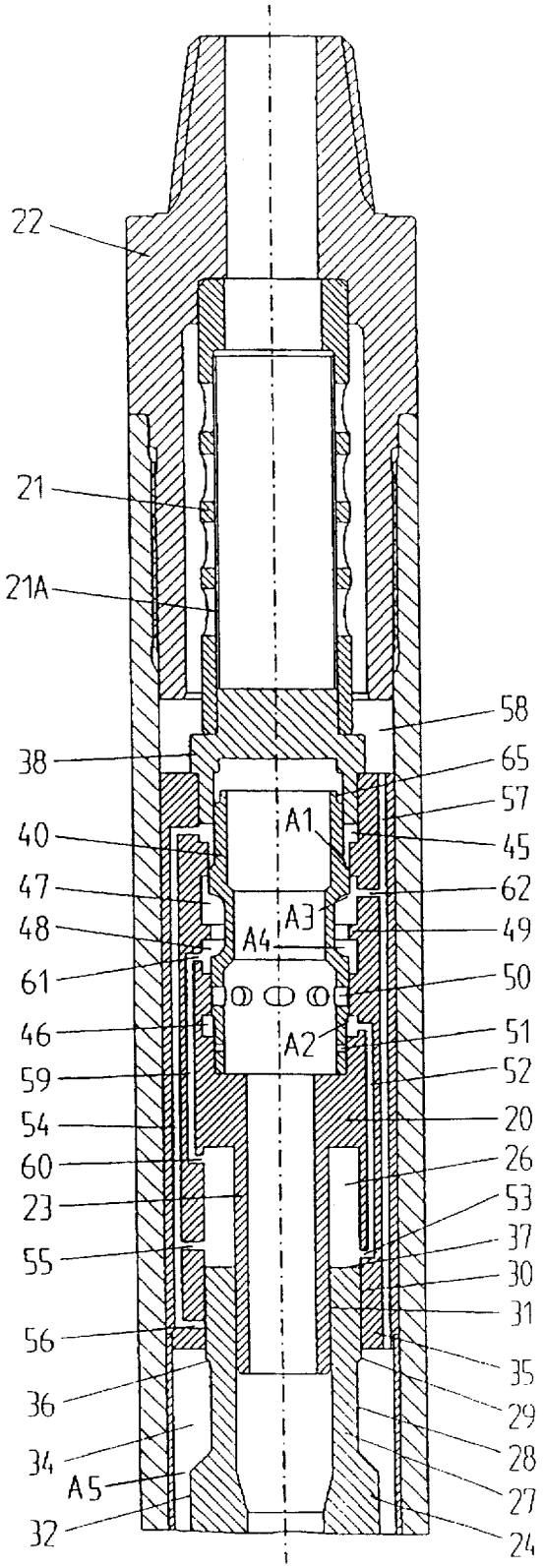
FIG. 3 is essentially the same as FIG. 1, but contains additional reference numerals.

Contained within the housing is a hydraulic impact motor (see FIG. 3). The hydraulic impact motor causes a piston hammer 24 to repetitively impact a target located in the front of the housing. The hydraulic impact motor includes a valve housing 20 containing a spool valve 40. As described further below, by way of spool valve 40 a first pressure chamber or a rear drive chamber 26, is cyclically pressurized and depressurized to generate the forward and return stroke of the piston hammer 24. The forward, or work, stroke of the piston hammer 24 impacts a target, preferably drill bit 14.

The return, or rearward, stroke of the piston hammer 24 can flush drained hydraulic fluid to the target, drill bit 14, for flushing the hole drilled by the bit 14. The return stroke of the piston hammer 24 is caused by depressurization of the rear drive chamber 26, allowing a second pressure chamber or front drive chamber 34, that is preferably continuously pressurized, to generate the return stroke of the piston hammer 24.

The drill bit 14 may be maintained in the housing by means of a sleeve 15 screwed into the tube 12. The sleeve 15 is in splined connection with the drill bit 14. The drill bit 14 is guided in the housing by the sleeve 15 and a guiding bushing 16 and a stop ring 17 prevents the drill bit 14 from falling out. The drill bit 14 is thus axially movable a limited distance in the cylindrical tube 12, and also cannot turn relative to the housing. In a conventional way, the drill bit 14 has an axial flushing fluid passage (not shown) that ends in flushing fluid ejecting holes in its front surface (not shown).

A guide bushing 18 can be supported against the shoulder 13 and a distance sleeve 19 can be supported against the guide bushing 18. The valve housing 20 with a back head 38 can be supported against the distance sleeve 19 and a tube formed filter support 21 with a filter 21*a* can be supported against the back head 38 of the valve housing 20. A backhead 22 of the machine housing is preferably screwed into the rear end of the tube 12, and it is arranged to axially clamp the parts 18, 19, 20, 38, 21 against the shoulder 13.

These parts 18, 19, 20, 38, 21 may act together as a spring and their cumulative length preferably is such that they are compressed when the backhead 22 is screwed into place. Preferably the parts 18, 19, 20, 38, 21 are made of steel with an overall axial compression of about 0.4 mm–2 mm. The distance sleeve 19 contributes most to this compression because of its dominating length and its comparatively small steel area in its cross section. It is preferably adapted to be compressed at least 0.3 and preferably about 0.8–3 pro mille of its length, or in other words, at least a strain of about 0.3 millimeters per meter and preferably about 0.8–3 millimeters per meter of its length.

The filter support 21 may have about the same cross section area of steel as the distance sleeve 19, but it is shorter and its contribution to the spring action is therefore smaller. The back head 38 of the valve housing 20 is preferably clamped against the main part of the valve housing 20.

When assembling the machine as shown in the embodiment, one puts all the parts 18, 19, 20, 38, 21 loosely on top of one another which makes the assembling simple and reduces the demand on axial tolerances. The added tolerance is taken up by the axial elastic compression. All the parts slide easily in the machine housing and are therefore easy to remove when the machine is to be disassembled.

In other words, and in accordance with one embodiment, the distance sleeve 19 acts as a spring or resilient member supporting the components placed above it. When assembling the machine as shown in the embodiment, the clamping force generated by screwing backhead 22 into place acts to compress distance sleeve 19 against guide bushing 18 abutting the shoulder 13. Cumulative axial tolerances of component parts 18, 19, 20, 38, and 21 can cause the total length of the combined parts to vary between one given set of components and another given set of components. Compression of the distance sleeve 19 allows variations in total length of the components 18, 19, 20, 38, and 21 to be essentially automatically compensated for at assembly.

All the components 18, 19, 20, 38, and 21 have some elasticity and are axially compressed to one degree or another by the clamping force generated by screwing backhead 22 onto the rear of tube 12. These component elasticities also aid assembly. However, distance sleeve 19 can be designed for optimum performance as a spring member allowing axial tolerances to be otherwise even more relaxed on the other components 18, 20, 38, and 21.

Further, filter support 21 can be viewed as a preferred embodiment of an additional distance sleeve, or rear distance sleeve, supported against the back head 38 of the valve housing 20. This rear distance sleeve 21 acts as an additional resilient member that can be compressed simultaneously with distance sleeve 19 for added compensation at assembly of the axial tolerances of the assembled component parts.

The backhead 22 of the machine housing may be arranged to be screwed to a conventional drill tubing (not shown) that transmits rotation to the drilling machine and also transmits hydraulic drive fluid in the form of pressurized water to the drilling machine. In operation, an annular space 58 at the back of the valve housing 20 is preferably thus continuously filled with filtered water under pressure.

A tube 23 can preferably form part of the valve housing 20. The piston hammer 24 can have a through channel and 25 preferably has its front end guided in the guide bushing 18. The rear end 27 of the piston hammer 24 preferably extends into annular cylinder chamber 26 (drive chamber) that is formed in the valve housing 20 between a sleeve-like front portion 35 of the valve housing 20 and the tube 23 of the valve housing 20. The rear end of the piston hammer 24 is thus preferably guided by the walls of the cylinder chamber 26, that is, by the valve housing 20. The rear end 27 of the piston hammer 24 has a groove 28 with a rear end wall 29 so that the piston hammer 24 has a defined outer guiding surface 30 behind the end wall 29. The piston hammer 24 has also an interior guiding surface 31 of defined length.

Preferably, the outer and inner guiding surfaces 30, 31 can have about the same length. The actual length of the guiding surfaces 30, 31 of the piston hammer 24 is defined by the guiding surfaces of the guide bushing 18 (at the front end of the piston hammer 24) and the guiding surfaces 30, 31 of the valve housing 20 (at the rear end of the piston hammer 24) and it preferably takes up only a minor part of the length of the piston hammer 24. The actual length of guiding is preferably less than 20% of the length of the piston hammer. The major part 32 of the piston hammer 24 is between these guiding surfaces 18, 30, and 31, and it has a wide clearance to the distance sleeve 19 of the machine housing 12.

Preferably, in order to get as heavy a piston hammer 24 as possible, the major part 32 of the piston hammer 24 can be radially enlarged as compared with its guided end portions.

As discussed below, the piston hammer 24 has two piston areas, a rear piston area and a forward piston area, to generate the forward and return stroke of the piston hammer 24. The rear piston area of the piston hammer 24 is represented by the annular piston area 37, and the forward piston area of the piston hammer 24 is represented by the differential piston area 36.

In accordance with the embodiment shown in FIG. 1 and FIG. 2, a guiding surface 33 of the piston hammer 24 which slides against the guide bushing 18 has a smaller diameter than the guiding surface 30 against the valve housing 20 so that the piston hammer 24 will have a differential piston area in the front drive chamber 34 that is formed axially between the guide bushing 18 and the valve housing 20. If the groove 28 and the front guiding surface 33 have the same diameter, then this differential area is represented by the area 36, that is, by the area of the rear wall 29 of the groove 28. This differential area 36 is smaller than the annular piston area 37 in the rear cylinder chamber 26.

Figure 4:
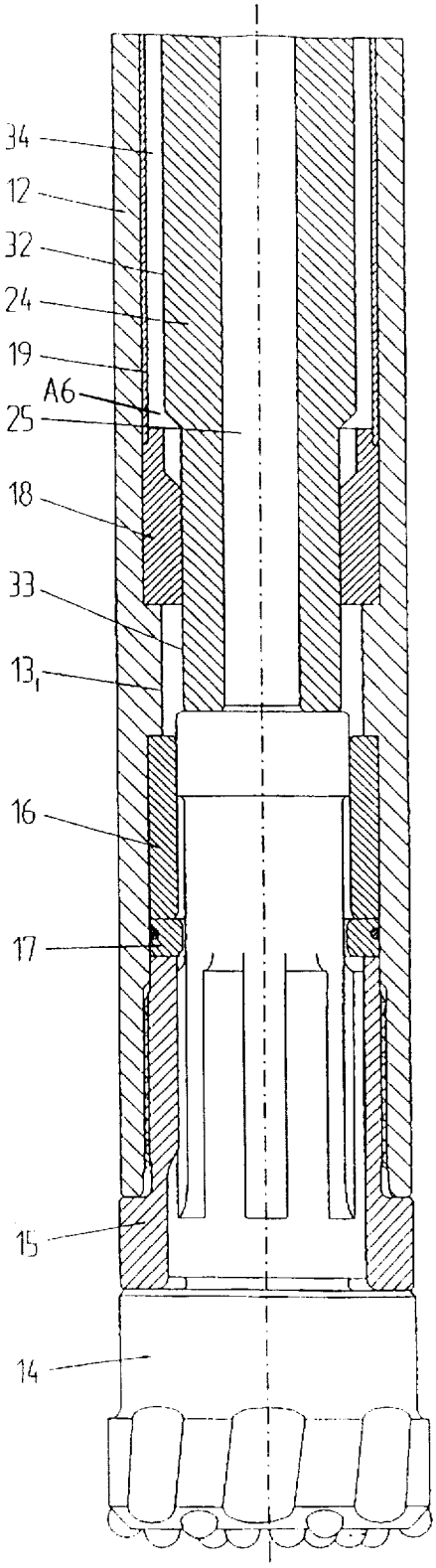
FIG. 4 is essentially the same as FIG. 2, but contains additional reference numerals.

In other words, and in accordance with one embodiment as shown in FIGS. 3 and 4, the rear piston area 36, piston area A5 (see FIG. 3), and piston area A6 (see FIG. 4) of piston hammer 24 are contained within front drive chamber 34. Each of the piston areas 36, A5, and A6 will generate an axial force on piston hammer 24 given. a working pressure within front drive chamber 34. However, the piston areas 36, A5, and A6 are designed so that front drive chamber generates a net axial force on piston hammer 24 that attempts to move piston hammer 24 in the direction of its return stroke. As shown in the preferred embodiment, the piston area of surface A5 is equal to the piston area of surface A6. Therefore the axial forces generated by a given working pressure within front drive chamber 34 acting on piston areas A5 and A6 would also be equal. However, because the axial force generated on piston area A5 would act opposite in direction to the axial force generated on piston area A6, these two forces effectively cancel each other and do not apply a net axial force to piston hammer 24. This leaves as the net axial force generated by front drive chamber 34 on piston hammer 24 only the axial force generated by the working pressure against piston area 36. Therefore piston area 36 will represent the differential piston area of piston areas 36, A5, and A6. The net axial force generated by front drive chamber 34 on piston hammer 24 therefore acts in the direction of the return stroke of the piston hammer 24.

Piston area 36 is preferably smaller in area than the annular piston area 37 contained in the rear cylinder chamber 26. When rear drive chamber 26 is pressurized to working pressure, the working pressure against annular piston area 37 will generate an axial force on piston hammer 24 that will attempt to move piston hammer 24 on its forward stroke. Because piston area 36 is preferably smaller than annular piston area 37, the axial force generated by rear drive chamber 26 is greater in magnitude than the axial force generated by front drive chamber 34.

The valve housing 20 contains the spool valve 40 with three control surfaces A1, A2, A3 that are in three annular control chambers 45, 46, 47. The effective area of surface A3 is a differential area, since the diameter of the sliding surface A3 of the spool valve 40 closer to the surface A1 is greater than the diameter of the sliding surface A4 (see FIG. 3) closer to the surface A2. This differential area A3–A4 will be represented by surface A3. The relation between these areas is A3<A1<A2+A3. The area A2 is greater than the area A3, and preferably A1 and A2 can be equal or about equal and about twice as large as A3.

In other words, the spool valve 40 has three control surfaces A1, A2, and A3 that each have an effective piston area, that is also represented by A1, A2, and A3, acted on by pressurization of the appropriate control chamber containing the control surface. Area A3 will represent the differential piston area A3–A4.

There is another annular chamber 48 and which is open to the annular chamber 47 when the spool valve 40 is in its illustrated (forward) position. When the spool valve 40 is in its other (rearward) position, a shoulder 49 in the valve housing 20 separates the chambers 47 and 48. The spool valve 40 has a row of large holes 50 and preferably two small holes 51.

A control conduit 52 leads between the annular chamber 46 and the rear cylinder chamber 26 and it has a control port 53 into the rear cylinder chamber 26. Another control conduit 54 leads between the annular chamber 45 and the rear drive chamber 26 and it has control ports 55 and 56 to the drive chambers 26 and 34 respectively. A number of parallel channels 57 lead axially through the valve housing 20 and connect the front drive chamber 34 with the continuously pressurized space 58 at the rear of the valve housing 20. A number of channels 59 connect a row of ports 60 into the rear drive chamber 26 with a row of ports 61 into the annular chamber 48. A number of channels connect a row of ports 62 into the annular chamber 47 with the continuously pressurized space 58 at the back of the valve housing 20.

A cycle of the operation of the machine will now be described.

Presume that the spool valve 40 is in its illustrated position and that the piston hammer 24 has just begun its work stroke forwardly in order to strike the drill bit 14. (The piston hammer 24 is shown in its impacting position.) Through ports 62, 61 and 60, the spool valve 40 connects the rear cylinder chamber 26 with the chamber 58 that is continuously under pressure. The control surface A1 of the valve is under pressure during the entire work stroke of the piston hammer 24 since the control port 56 of the control passage 54 is at first open to the continuously pressurized front drive chamber 34 and then, shortly after the closing of the port 56, the control port 55 of the control passage 54 is instead opened to the rear drive chamber 26 which is under pressure.

As shown, the length of the guide surface 30 of the piston hammer 24 can be such that both ports 56 and 55 are closed during a short period, which, however, will be so short that it will not influence the pressure in the control passage 54. As long as the control port 53 of the control passage 52 is closed, the spool valve 40 will therefore remain stable in its illustrated forward position because the area A1 overcomes the area A3. The leakage from the annular chamber 46 prevents a pressure build up in the annular chamber 46.

When the piston hammer 24 in its work stroke opens the control port 53 of the control passage 52 just after it has opened the control port 55 of the control passage 54, the passage 52 and the annular chamber 46 are pressurized, and since the area A2 that is then put under pressure equals the area A1 that is already under pressure, these areas balance each other and the area A3 will force the spool valve 40 into its rearward position which is not illustrated. The holes 51 in the spool valve 40 will be open into the annular chamber 46, but they are so small that they do not prevent the pressurization of the annular chamber 46. The leakage through the holes 51 is so small that it does not significantly influence the overall power efficiency.

The spool valve 40 is dampened by its nose 65 cutting off a damping chamber so that the valve 40 is retarded before it lands in its rear non-illustrated position and it will therefore not tend to rebound. The annular chamber 48 is cut off from the annular chamber 47 and is instead coupled to the interior of the valve 40 through the holes 50 in the valve 40. Through the tube 23, the interior of the valve is continuously open to the channel 25 in the piston hammer 24 and the channel 25 is always open to the flushing fluid passage in the drill bit 14. The rear drive chamber 26 will therefore be depressurized simultaneously with the piston hammer 24 reaching its impacting position, and the continuously pressurized front drive chamber 34 starts to drive the piston hammer 24 rearwardly in its return stroke.

The relative axial positions of the control ports 53 and 55 can preferably be varied, and the control port 53 need not be axially forwardly of the port 55.

The water that flows out of the rear drive chamber 26 during the return stroke of the piston hammer 24 can thus be utilized as a flushing fluid for flushing the debris out of the borehole.

When the rear drive chamber 26 is depressurized, the control surfaces A1 and A2 are both depressurized since both the port 55 of the control passage 52 and the port 53 of the control passage 52 will be open to the rear drive chamber 26.

During its return stroke, the piston hammer 24 will close the ports 55 and 53. The annular chamber 46 will however remain drained; now through the small holes 51 through the spool valve 40. Then the piston hammer 24 opens the port 56 of the control passage 54 so that the control passage 54 and the annular chamber 45 will be pressurized from the front drive chamber 34 and the surface A1 will be pressurized. Since the surface A2 is not pressurized, the surface A1 will force the spool valve 40 to switch to its forward position shown.

During the last portion of the forward movement of the spool valve 40, the two small holes 51 in the valve are cut off from the annular chamber 46, and the water closed in the chamber 46 and the control passage 53 retards the valve 40 before the valve 40 lands since a pressure will build up against the control surface A2. This pressure cannot be so high that it jeopardizes the spool valve 40 staying stably in its forward position since the row of large holes 50 in the valve 40 is close to the annular chamber 46. The leakage out through the holes 50 together with the leakage past the end of the spool valve 40 will be comparatively big and bigger than the leakage into the closed port 53. The valve 40 will now pressurize the rear drive chamber 26 via the ports 62, 61, 60 and the passages 59 between the ports 61 and 60 so that the piston hammer 24 decelerates, turns and accelerates in its work stroke as previously described and the cycle is repeated.

To summarize the operating cycle of the hydraulic impact motor in the preferred embodiment shown in FIGS. 1 and 2, pressurization of the rear drive chamber 26 causes the piston hammer 24 to move in its forward stroke via pressurization of piston area 37. Depressurization of the rear drive chamber 26 causes the piston hammer 24 to move in its return stroke, the return stroke generated by the continuously pressurized front drive chamber 34 acting on piston area 36.

The pressurization and depressurization of rear drive chamber 26 is controlled by the position of the spool valve 40. The spool valve 40 has two operating positions. The first operating position is shown in FIGS. 1 and 2, and pressurizes the rear drive chamber 26. The second operating position (not shown) has the spool valve 40 displaced rearward against the back head 38. This position causes the rear drive chamber 26 and control surfaces A1 and A2 to be depressurized. Because of the continuous bias pressure on control surface A3, the spool valve 40 remains in the second operating position despite depressurization of control surfaces A1 and A2.

The cyclic movement of the spool valve 40 from the first operating position to the second operating position is controlled by the position of the piston hammer 24. When the piston hammer 24 has moved forward to strike the drill bit 14, the control surface A2 is pressurized to move the spool valve 40 to its second operating position, depressurizing control surface A2. When the piston hammer 24 has reached the limit of its return stroke, control surface A1 is pressurized to move the spool valve 40 to its first operating position.

The startup of the machine will now be described.

At startup, it is assumed the machine is in an initial depressurized state. Pressurized water enters the machine via backhead 22 and pressurizes annular space 58 as described above. A number of parallel channels 57 lead axially through the valve housing 20 and connect front drive chamber 34 with space 58. Hence the front drive chamber 34 is essentially immediately pressurized at startup. Similarly, a number of channels connect a row of ports 62 into the annular chamber 47 with the pressurized space 58 to essentially immediately pressurize chamber 47 at startup.

At startup it cannot be assumed the spool valve 40 or the piston hammer 24 are in any particular configuration. Therefore different configuration states will be analyzed, each assuming the machine now has a pressurized front drive chamber 34 and a pressurized annular chamber 47 as described in the preceding paragraph.

Further, the limiting axial positions of the piston hammer 24 can preferably be defined. Rearward travel of the piston hammer 24 can be limited by interference with tube 23, and be limited so that port 60 preferably remains open. Alternatively, rearward travel of the piston hammer 24 can be limited by interference of the valve housing 20 with surface A5 (see FIG. 3). Or rearward travel of the piston hammer 24 can be limited by interference of the valve housing 20 with surface 37, effectively closing rear drive chamber 26 and closing port 60. Leakage of hydraulic fluid from port 60 into the rear drive chamber 26 could then pressurize piston area 37 as needed.

Forward travel of the piston hammer 24 can be limited by impact with the target, the drill bit 14 (as shown in FIG. 2). At this forward limit, a clearance can exist between surface A6 and guide bearing 18, and the piston area of surface A6, assuring the piston area of surface A6 can be pressurized at startup.

First, assume the spool valve 40 at startup is in the forward position shown in FIG. 2. Annular chamber 47 is in communication with annular chamber 48, and via port 62, passage 59, and port 60, rear drive chamber 26 will be pressurized.

If the piston hammer 24 is at its rearward limit of travel (not shown), ports 53 and 55 would be closed. Port 56 would be open. The open port 56 communicates with front drive chamber 34 and would pressurize piston area A1 via channel 54 and annular chamber 45, keeping spool valve 40 in its forward position. Pressurization of rear drive chamber 26 will start the piston hammer 24 on its forward stroke, beginning the operating cycle.

If the piston hammer 24 is in an intermediate axial position (with port 53 closed), ports 55 and 56 may be open or closed at startup. If either port 55 or 56 is open, then piston area A1 would be pressurized, either by the front drive chamber 34 via port 56 or by the rear drive chamber 26 via port 55. Spool valve 40 would thereby be kept in its forward position, and piston hammer 24 will complete its forward stroke, beginning the operating cycle.

If ports 55 and 56 are closed at startup, pressurization of rear drive chamber 26 will start the piston hammer 24 forward. Port 55 would subsequently open during the initial forward stroke, pressurizing piston area A1 as in the regular operating cycle.

If the piston hammer 24 is at or near its forward limit of travel, ports 53 and 55 will be open at startup. Pressurization of rear drive chamber 26 would pressurize piston area A1 (via port 55), and would pressurize piston A2 (via port 53). Spool valve 40 would be displaced to its rearward position, depressurizing rear drive chamber 26 and allowing the piston hammer 24 to begin a rear stroke via pressurization of piston area 36.

Next, assume the spool valve 40 is at an intermediate position between its forward and rear stable positions. If spool valve 40 is sufficiently forward such that annular chamber 47 and annular chamber 48 remain in communication, then the startup process will be identical to that described for the spool valve 40 being fully forward as described previously above.

If spool valve 40 is at or near the rear stable position, then shoulder 49 prevents communication between annular chamber 47 and annular chamber 48. Hence, rear drive chamber 26 will not be immediately pressurized at startup.

If the piston hammer 24 is at its rearward limit of travel (not shown), ports 53 and 55 would be closed. Port 56 would be open. The open port 56 communicates with front drive chamber 34 and would pressurize piston area A1 via channel 54 and annular chamber 45, driving the spool valve 40 to its forward stable position. Annular chamber 48 would now communicate with annular chamber 47, pressurizing rear drive chamber 26. Pressurization of rear drive chamber 26 will start the piston hammer 24 on its forward stroke, beginning the operating cycle.

If the piston hammer 24 is in an intermediate axial position (with port 53 closed), ports 55 and 56 may be open or closed at startup. If either port 55 or 56 is open, then piston area A1 would be pressurized, either by the front drive chamber 34 via port 56 or by the rear drive chamber 26 via port 55. Spool valve 40 would thereby be driven to its forward stable position, and piston hammer 24 will complete its forward stroke, beginning the operating cycle.

If ports 55 and 56 are closed at startup, pressurization of front drive chamber 34 will start the piston hammer 24 rearward to begin the operating cycle (rear drive chamber 26 would not yet be pressurized). Port 56 would subsequently open during the initial rearward stroke, pressurizing piston area A1 as in the regular operating cycle.

If the piston hammer 24 is at or near its forward limit of travel, ports 53 and 55 will be open at startup. However, rear drive chamber 26 would not be pressurized, so pressurization of front drive chamber 34 will start the piston hammer 24 rearward to begin the operating cycle.

One feature of the invention resides broadly in the hydraulic impact motor comprising a housing 12, a piston hammer 24 reciprocable in said housing and driven to reciprocate by the pressure in two pressure chambers 26, 34, a spool valve 40 for alternately pressurizing and draining at least one of said pressure chambers so as to reciprocate the piston hammer, said spool valve having a first control surface A1 in a first control chamber 45 and a second control surface A2 in a second control chamber 46 and opposite directed relative to said first control surface, said first and second control chambers 45, 46 being arranged to be pressurized and depressurized, in response to the position of the piston hammer, through control ports 53, 55, 56 controlled by the hammer piston and control conduits 52, 54, characterized by a third control surface A3 on the spool valve in a continuously pressurized chamber 47 and acting in the same direction as said second control surface A2, said second and third control surfaces A2, A3 being greater than said first control surface A1 and the first control surface A1 being greater than the third control surface A3 so that the spool valve 40 is moved in the one direction when the first control chamber 45 is pressurized and the second control chamber 46 is depressurized and moved in the other direction when the first and second control/chambers 45, 46 have equal pressure.

Another feature of the invention resides broadly in an impact motor characterized in that said first control chamber 45 is arranged to be pressurized from one of the drive chambers 26 for the piston hammer 24 for initiating the movement of the spool valve 40 in said one direction, and said second control chamber 46 is arranged to be pressurized from the other one of said drive chambers 34 for initiating the movement of the spool valve 40 in the other direction.

Yet another feature of the invention resides broadly in an impact motor, characterized in that the piston hammer 24 is guided at its front end and at its rear end and is unguided therebetween, a rear control surface for controlling the spool valve 40 is defined between a surface 37 in said one drive chamber 26, that is a rear drive chamber, and a surface 36 in the other drive chamber 34, that is a continuously pressurized front drive chamber, the control conduit 54 to the first control chamber 45 has a port 56 arranged to be opened to the front drive chamber 34 and a port 55 arranged to be opened to the rear drive chamber 26, and the control conduit 52 to said other control chamber 46 has a port 53 arranged to be opened into the rear drive chamber 26.

Still another feature of the invention resides broadly in the impact motor characterized in that it is an in-hole rock drilling machine and the spent drive fluid expelled from the spool valve 40 is conveyed through a channel 25 in the piston hammer 24 to the drill bit 14 of the drilling machine as a flushing fluid.

A further feature of the invention resides broadly in an in-hole rock drilling machine comprising a tubular housing 12 with a guide bushing 18 in the front end of the housing arranged to guide the front end of a piston hammer 24 and a valve housing 20 in the rear end of the housing arranged to guide the rear end of the piston hammer, characterized in that the guide bushing 18, the valve housing 20, and a distance sleeve 19 between them are clamped together against a support 13 for the guide bushing by means of a back head 22 screwed to the housing, said distance tube 19 being adapted to be compressed at least 0.3 pro mille, or 0.3 millimeters per meter, of its length.

A still further feature of the invention resides broadly in the machine characterized in that the distance sleeve 19 is adapted to be compressed axially at least 0.8 pro mille, or 0.8 millimeters per meter, of its length.

Yet an additional feature of the invention resides broadly in the machine characterized in that the distance sleeve 19 is adapted to be compressed 0.3–3 pro mille, or 0.3–3 millimeters per meter, of its length.

Still another feature of the invention resides broadly in the machine characterized in that an element 21 between the valve housing 20 and the back head 22 is adapted to be axially compressed at least 0.3 pro mille, or 0.3 millemeters per meter, of its length.

A further feature of the invention resides broadly in the machine characterized in that said element 21 is a filter support.

An additional further feature of the invention resides broadly in a hydraulic in-hole rock drilling machine that has a housing 12, a piston hammer 24 disposed in the housing 12 to repetitively deliver impacts to a drill bit 14 mounted at the front end of the housing 12, with the reciprocation of the piston hammer 24 by pressurizing and draining of at least one of a first pressure chamber 26 and a second pressure chamber 34, the pressurizing and draining of at least one the first pressure chamber 26 and the second pressure chamber 34 controlled by a spool valve 40, the spool valve 40 being moveable between a first operating position and a second operating position, the first operating position for pressurizing at least one of the first pressure chamber 26 and the second pressure chamber 34, the second operating position for draining at least one of the first pressure chamber 26 and the second pressure chamber 34, the spool valve 40 movable to the first operating position by pressurizing a first control chamber 45 and draining a second control chamber 46, and the spool valve 40 movable to the second operating position by pressurizing the second control chamber 46 and a continuously pressured third control chamber 47, the continuously pressured third control chamber 47 generating a continuous pressure bias of the spool valve 40 towards the second operating position, the first control chamber 45 pressurized and drained in response to the position of the piston hammer 24, and the second control chamber 46 pressurized and drained in response to the position of the piston hammer 24.

Yet another feature of the invention resides broadly in an in-hole rock drilling machine that has a housing 12, the housing 12 having a support 13, a piston hammer 24 disposed within the housing 24, with the front end of piston hammer 24 guided by a guide bushing 18, a distance sleeve 19 located between the guide bushing 18 and a valve housing 20, the distance sleeve 19 having an elasticity, with assembly of the component parts 18, 19, 20 by clamping the component parts 18, 19, 20 against the housing support 13, the elasticity of distance sleeve 19 compensating for axial tolerances of the clamped components 18, 19, 20.

A still additional further feature of the invention resides broadly in a hydraulic impact motor that has a housing 12, a piston hammer 24 disposed in the housing 12 to repetitively deliver impacts to a target, as for example, a drill bit 14 mounted at the front end of the housing 12, with the reciprocation of the piston hammer 24 by pressurizing and draining of at least one of a first pressure chamber 26 and a second pressure chamber 34, the pressurizing and draining of at least one the first pressure chamber 26 and the second pressure chamber 34 controlled by a spool valve 40, the spool valve 40 being moveable between a first operating position and a second operating position, the first operating position for pressurizing at least one of the first pressure chamber 26 and the second pressure chamber 34, the second operating position for draining at least one of the first pressure chamber 26 and the second pressure chamber 34, the spool valve 40 movable to the first operating position by pressurizing a first control chamber 45 and draining a second control chamber 46, and the spool valve 40 movable to the second operating position by pressurizing the second control chamber 46 and a continuously pressured third control chamber 47, the continuously pressured third control chamber 47 generating a continuous pressure bias of the spool valve 40 towards the second operating position, the first control chamber 45 pressurized and drained in response to the position of the piston hammer 24, and the second control chamber 46 pressurized and drained in response to the position of the piston hammer 24.

Examples of in-hole rock drilling machines which could possibly be adapted for use in the present invention, along with additional components generally associated with in-hole drilling machines which might be interchangeable with, or adaptable as, components of the embodiments as described hereinabove, might be disclosed by the following U.S. Patents, all of which were invented by the inventor for the present invention: U.S. Pat. No. 5,014,796, and U.S. Pat. No. 5,107,944.

Some additional examples of in-hole rock drilling machines which could possibly be used in the context of the present invention might be disclosed by the following U.S. Pat. Nos. 5,435,401, 5,407,021, 5,320,189, 5,318,140, 5,207,283, and 3,924,690.

Further examples of in-hole rock drilling machines which could possibly be adapted for use in the present invention, along with additional components generally associated with in-hole drilling machines which might be interchangeable with, or adaptable as, components of the embodiments as described hereinabove, might be disclosed by the following German patents: No. DE-B 2-2362724, and No. DE-C 2-3343565.

Examples of drill bits which could possibly be used or adapted for use in the context of the present invention might be disclosed by the following U.S. Pat. Nos. 5,366,032, 5,358,063, 5,197,555, 5,025,875, 4,953,642, and 4,911,729.

The components disclosed in the various publications, disclosed or incorporated by reference herein, may be used in the embodiments of the present invention, as well as equivalents thereof.

The appended drawings in their entirety, including all dimensions, proportions, and/or shapes in at least one embodiment of the invention are accurate and to scale and are hereby included by reference into this specification.

All, or substantially all, of the components and methods of the various embodiments may be used with at least one embodiment or all of the embodiments, if more than one embodiment is described herein.

All of the patents, patent applications, and publications recited herein, and in the Declaration attached hereto, are hereby incorporated by reference as if set forth in their entirety herein.

The corresponding foreign and international patent publication applications, namely, Swedish Patent Application No. 9304124-2, filed on Dec. 13, 1993, and International Application No. PCT/SE94/01196, filed on Dec. 13, 1994, having inventor Per Gustaffson, and Swedish Patent Application No. 9304125-9, filed on Dec. 13, 1993, and International Application No. PCT/SE94/01201, filed on Dec. 13, 1994, having inventor Per Gustaffson, as well as their published equivalents, and other equivalents or corresponding applications, if any, in corresponding cases in Sweden and elsewhere, and the references cited in any of the documents cited herein, are hereby incorporated by reference as if set forth in their entirety herein.

The details in the patents, patent applications, and publications amy be considered to be incorporable, at Applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirt and scope of the invention.

What is claimed is:

1. A hydraulic in-hole rock drilling machine comprising:

a housing;

said housing comprising a front end;

said housing comprising a rear end;

means for mounting a drill bit at the front end of said housing;

means for admitting pressurized hydraulic fluid to said housing;

a piston hammer;

said piston hammer being disposed in said housing;

said piston hammer being disposed to repetitively deliver impacts to a drill bit;

means for reciprocating said piston hammer to repetitively impact a drill bit;

said reciprocating means being disposed in said housing;

said reciprocating means comprising:

a first pressure chamber;

a second pressure chamber;

means for pressurizing at least one of said first pressure chamber and said second pressure chamber;

means for draining at least one of said first pressure chamber and said second pressure chamber;

means for driving said piston hammer forwardly towards a drill bit upon said at least one of: said first pressure chamber and said second pressure chamber being pressurized;

means for driving said piston hammer rearwardly away from a drill bit upon said at least one of: said first pressure chamber and said second pressure chamber being drained;

valve means for alternately pressurizing and draining said at least one of: said first pressure chamber and said second pressure chamber;

said valve means comprising:

a first control chamber;

a second control chamber;

a third control chamber;

means for pressurizing and draining said first control chamber in response to the position of said piston hammer;

means for pressurizing and draining said second control chamber in response to the position of said piston hammer;

means for continuously pressurizing said third control chamber;

a spool valve;

said spool valve being moveable between a first operating position and a second operating position;

said means for pressurizing at least one of: said first pressure chamber and said second pressure chamber comprising means for being activated in the first operating position of said spool valve;

said means for draining at least one of: said first pressure chamber and said second pressure chamber comprising means for being activated in the second operating position of said spool valve;

said spool valve comprising means for generating a continuous pressure bias by said third control chamber towards said second operating position of said spool valve;

said spool valve comprising means for moving said spool valve to the second operating position by pressurization of said second control chamber; and said spool valve comprising means for moving said spool valve to the first operating position by pressurization of said first control chamber and draining of said second control chamber.

2. The hydraulic in-hole rock drilling machine according to claim 1, wherein:

said spool valve comprises:

a first control surface;

a second control surface; and a third control surface;

said first control surface is disposed in said first control chamber;

said second control surface is disposed in said second control chamber;

said third control surface is disposed in said third control chamber;

said means for moving said spool valve to the first operating position comprises said first control surface;

said means for moving said spool valve to the second operating position comprises said second control surface and said third control surface; and said means for generating a continuous pressure bias comprises said third control surface.

3. The hydraulic in-hole rock drilling machine according to claim 2, wherein:

said first control surface has a first piston area;

said second control surface has a second piston area;

said third control surface has a third piston area;

the sum of said second piston area and said third piston area is greater than said first piston area; and said first piston area is greater than said third piston area.

4. The hydraulic in-hole rock drilling machine according to claim 3, further comprising:

means for pressurizing said first control chamber by said first pressure chamber; and means for pressurizing said second control chamber by said second pressure chamber.

5. The hydraulic in-hole rock drilling machine according to claim 4, further comprising:

said means for pressurizing at least one of: said first pressure chamber and said second pressure chamber comprising means for selectively pressurizing said first pressure chamber;

said means for draining at least one of: said first pressure chamber and said second pressure chamber comprising means for selectively draining said first pressure chamber;

means for continuously pressurizing said second pressure chamber;

said means for driving said piston hammer rearwardly comprising said second pressure chamber;

said piston hammer comprising a piston surface;

said piston surface of said piston hammer being disposed in said first pressure chamber;

said means for driving said piston hammer forwardly comprising said piston surface of said piston hammer;

said piston hammer comprising an additional piston surface;

said additional piston surface of said piston hammer being disposed in said second pressure chamber;

said means for driving said piston hammer rearwardly comprising said additional piston surface of said piston hammer;

said means for pressurizing said first control chamber comprising said second drive chamber;

said means for draining said first control chamber comprising draining said first pressure chamber; and said means for pressurizing said second control chamber comprising said first pressure chamber.

6. The hydraulic in-hole rock drilling machine according to claim 5, further comprising:

means for guiding the front end of said piston hammer;

means for guiding the rear end of said piston hammer; and a substantial portion of the length of said piston hammer being unguided and located between said front guiding means and said rear guiding means.

7. The hydraulic in-hole rock drilling machine according to claim 6, further comprising:

means for flushing drained hydraulic fluid to a drill bit;

said flushing means comprising:

said spool valve;

said spool valve comprising means for draining the hydraulic fluid;

a channel disposed in said piston hammer;

said channel having a forward end;

said channel having a rear end;

said forward end being disposed nearer the front end of said housing than said rear end;

said channel extending through the length of said piston hammer;

the forward end of said channel being disposed to supply drained hydraulic fluid to a drill bit; and the rear end of said channel being disposed to receive drained hydraulic fluid from said spool valve.

8. An in-hole rock drilling machine comprising:

a housing;

a piston hammer;

said piston hammer having a front end and a rear end;

said piston hammer being disposed in said housing;

means for guiding said front end of said piston hammer;

said means for guiding said front end of said piston hammer comprising a guide bushing;

means for guiding said rear end of said piston hammer;

said means for guiding said rear end of said piston hammer comprising a valve housing;

a distance sleeve;

said distance sleeve having an elasticity;

said distance sleeve being disposed between said guide bushing and said valve housing;

said housing further comprising a support;

means for assembling said valve housing, said distance sleeve and said guide bushing within said housing;

said assembly means comprising means for clamping said valve housing, said distance sleeve and said guide bushing against said housing support;

said assembly means comprising means for compensating for the axial tolerances of said valve housing, said distance sleeve and said guide bushing; and said axial tolerance compensating means comprising the elasticity of said distance sleeve.

9. The in-hole drilling machine according to claim 8, wherein:

said distance sleeve comprises steel; and said assembly means comprises means for compressing said distance sleeve a minimum of about 0.3 millimeters per meter of length of said distance sleeve.

10. The in-hole drilling machine according to claim 9, wherein:

said assembly means comprises means for compressing said distance sleeve a minimum of about 0.8 millimeters per meter of length of said distance sleeve; and said assembly means comprises means for compressing said distance sleeve a maximum of about 3 millimeters per meter of length of said distance sleeve.

11. The in-hole drilling machine according to claim 10, further comprising:

a rear distance element;

said rear distance element having an elasticity;

said means for assembling further comprising means for assembling said rear distance element, valve housing, distance sleeve and guide bushing within said housing;

said assembly means further comprising means for clamping said rear distance element, said valve housing, said distance sleeve and said guide bushing against said housing support; and said axial tolerance compensating means further comprising the elasticity of said rear distance element.

12. The in-hole drilling machine according to claim 11, wherein:

said rear distance sleeve comprises steel; and said assembly means comprises means for compressing said rear distance sleeve a minimum of about 0.3 millimeters per meter of length of said rear distance sleeve.

13. The in-hole drilling machine according to claim 12, wherein:

said rear distance element is a filter support; and said filter support comprises means for carrying a filter for filtering pressurized hydraulic fluid admitted to said housing.

14. A hydraulic impact motor comprising:

a housing;

said housing comprising a front end;

said housing comprising a rear end;

means for mounting a target;

a target being disposed at said front end of said housing;

means for admitting pressurized hydraulic fluid to said housing;

a piston hammer;

said piston hammer being disposed in said housing;

said piston hammer being disposed to repetitively deliver impacts to a target;

means for reciprocating said piston hammer to repetitively impact a target;

said reciprocating means being disposed in said housing;

said reciprocating means comprising:

a first pressure chamber;

a second pressure chamber;

means for pressurizing at least one of said first pressure chamber and said second pressure chamber;

means for draining at least one of said first pressure chamber and said second pressure chamber;

means for driving said piston hammer forwardly towards a target upon said at least one of: first pressure chamber and second pressure chamber being pressurized;

means for driving said piston hammer rearwardly away from a target upon said at least one of: first pressure chamber and second pressure chamber being drained;

valve means for alternately pressurizing and draining said at least one of: said first pressure chamber and said second pressure chamber;

said valve means comprising:

a first control chamber;

a second control chamber;

a third control chamber;

means for pressurizing and draining said first control chamber in response to the position of said piston hammer;

means for pressurizing and draining said second control chamber in response to the position of said piston hammer;

means for continuously pressurizing said third control chamber;

a spool valve;

said spool valve being moveable between a first operating position and a second operating position;

said means for pressurizing at least one of: said first pressure chamber and said second pressure chamber comprising means for being activated in the first operating position of said spool valve;

said means for draining at least one of: said first pressure chamber and said second pressure chamber comprising means for being activated in the second operating position of said spool valve;

said spool valve comprising means for generating a continuous pressure bias by said third control chamber towards the second operating position of said spool valve;

said spool valve comprising means for moving said spool valve to the second operating position by pressurization of said second control chamber; and said spool valve comprising means for moving said spool valve to the first operating position by pressurization of said first control chamber and draining of said second control chamber.

15. The hydraulic impact motor according to claim 14, wherein:

said spool valve comprises:

a first control surface;

a second control surface; and a third control surface;

said first control surface is disposed in said first control chamber;

said second control surface is disposed in said second control chamber;

said third control surface is disposed in said third control chamber;

said means for moving said spool valve to the first operating position comprises said first control surface;

said means for moving said spool valve to the second operating position comprises said second control surface and said third control surface; and said means for generating a continuous pressure bias comprises said third control surface.

16. The hydraulic impact motor according to claim 15, wherein:

said first control surface has a first piston area;

said second control surface has a second piston area;

said third control surface has a third piston area;

the sum of said second piston area and said third piston area is greater than said first piston area; and said first piston area is greater than said third piston area.

17. The hydraulic impact motor according to claim 16, further comprising:

means for pressurizing said first control chamber by said first pressure chamber; and means for pressurizing said second control chamber by said second pressure chamber.

18. The hydraulic impact motor according to claim 17, further comprising:

said means for pressurizing at least one of: said first pressure chamber and said second pressure chamber comprising means for selectively pressurizing said first pressure chamber;

said means for draining at least one of: said first pressure chamber and said second pressure chamber comprising means for selectively draining said first pressure chamber;

means for continuously pressurizing said second pressure chamber;

said means for driving said piston hammer rearwardly comprising said second pressure chamber;

said piston hammer comprising a rear piston surface;

said rear piston surface being disposed in said first pressure chamber;

said means for driving said piston hammer forwardly comprising said rear piston surface;

said piston hammer comprising a forward piston surface;

said forward piston surface being disposed in said second pressure chamber;

said means for driving said piston hammer rearwardly comprising said forward piston surface;

said means for pressurizing said first control chamber comprising said second drive chamber;

said means for draining said first control chamber comprising draining said first pressure chamber; and said means for pressurizing said second control chamber comprising said first pressure chamber.

19. The hydraulic impact motor according to claim 18, further comprising:

means for guiding the front end of said piston hammer;

means for guiding the rear end of said piston hammer; and a substantial portion of the length of the piston hammer being unguided and located between said front guiding means and said rear guiding means.

20. The hydraulic impact motor according to claim 19, further comprising:

means for flushing drained hydraulic fluid to a target; and said flushing means comprising:

said spool valve;

said spool valve comprising means for draining the hydraulic fluid;

a channel disposed in said piston hammer;

said channel having a forward end;

said channel having a rear end;

said forward end being disposed nearer the front end of said housing than said rear end;

said channel extending the length of said piston hammer;

the forward end of said channel disposed to supply drained hydraulic fluid to a target; and the rear end of said channel disposed to receive drained hydraulic fluid from said spool valve.

* * * * *

UNITED STATES PATENT AND TRADEMARK OFFICE

CERTIFICATE OF CORRECTION

PATENT NO. : 5,715,897

DATED : February 10, 1998

INVENTOR(S) : Per GUSTAFSSON

It is certified that error appears in the above-identified patent and that said Letters Patent is hereby corrected as shown below:

On the title page, item [63], first line, after 'of', delete "PCT/SE094/01196," and insert --PCT/SE 94/01196,--.

In column 2, line 20, after 'invention' insert --is--.

In column 4, line 23, after 'being', delete "moveable" and insert --movable--.

In column 6, line 42, after 'channel' delete "and".

In column 6, line 43, after '25' insert --and--.

UNITED STATES PATENT AND TRADEMARK OFFICE

CERTIFICATE OF CORRECTION

PATENT NO. : 5,715,897

DATED : February 10, 1998

INVENTOR(S) : Per GUSTAFSSON

It is certified that error appears in the above-identified patent and that said Letters Patent is hereby corrected as shown below:

In column 13, line 19, before 'between', delete "moveable" and insert --movable--.

In column 13, line 58, after 'being', delete "moveable" and insert --movable--.

In column 15, line 57, Claim 1, after 'being', delete "moveable" and insert --movable--.

In column 19, line 27, Claim 14, after 'being', delete "moveable" and insert --movable--.

Signed and Sealed this

First Day of September, 1998

Bruce Lehman

*Attest:*

BRUCE LEHMAN

*Attesting Officer*

*Commissioner of Patents and Trademarks*